United States Patent [19]

Hwang

[11] Patent Number: 4,888,667

[45] Date of Patent: Dec, 19, 1989

[54] LIPSTICK CAP WITH LAMP DEVICES

[76] Inventor: Kuo H. Hwang, 115, Kuo Tze Lih, Pei Twen District, Taichung, Taiwan

[21] Appl. No.: 338,728

[22] Filed: Apr. 14, 1989

[51] Int. Cl.[4] ..... F21V 33/00

[52] U.S. Cl. ..... 362/109; 362/119; 206/385; 206/457; 132/318

[58] Field of Search ..... 362/109, 119, 120, 204, 362/205, 206; 206/385, 457; 132/288, 317, 318

[56] References Cited

U.S. PATENT DOCUMENTS

| | | | |
|---|---|---|---|
| 2,269,750 | 1/1942 | Baud | 362/119 |
| 2,651,709 | 9/1953 | Ross et al. | 132/318 X |
| 2,678,995 | 5/1954 | Miller | 132/318 X |
| 2,779,344 | 1/1957 | Hemmings et al. | 132/288 |

FOREIGN PATENT DOCUMENTS

| | | | |
|---|---|---|---|
| 829652 | 12/1951 | Fed. Rep. of Germany | 362/109 |
| 551375 | 11/1956 | Italy | 362/109 |
| 356876 | 10/1961 | Switzerland | 132/318 |

*Primary Examiner*—Ira S. Lazarus
*Assistant Examiner*—Peggy Neils
*Attorney, Agent, or Firm*—Asian Pacific International Patent and Trademark Office

[57] ABSTRACT

A lipstick cap with lamp devices, including a cap sleeve used to receive common lipstick seat, and a rotary switch rotarily engaged with the cap sleeve, wherein the cap sleeve is equipped with several lamp devices and a pair of conducting plates electrically connect the lamp devices in series, and the rotary switch has a battery container including an anode and cathode conducting plates which can be selectively electrically connected with the conducting plates of the lipstick cap by means of rotating the rotary switch thereabout whereby when a battery is disposed in the battery container, the lamp devices can be alternatively lighted up in case of applying the lipstick in a dimly lighted place.

4 Claims, 3 Drawing Sheets

LIPSTICK CAP WITH LAMP DEVICES

BACKGROUND OF THE INVENTION

The lipstick has been an essential cosmetic since long. The conventional lipstick is typically installed on a seat body with which a cap body can associate to contain the lipstick. When applying the lipstick, a user must take off the cap, holding the same with one hand, and hold the seat body with the other hand. Since a mirror is necessary to apply the lipstick, the cap thus always becomes obstructive to holding a mirror. In addition, the lipstick is difficult to be used in a dim condition.

SUMMARY OF THE INVENTION

It is therefore an object of the present invention to provide a lipstick cap which can be alternatively associated with one end of the lipstick seat body or the other end thereof without the necessity of holding.

It is a further object of the present invention to provide a lipstick cap having lamp devices, serving as a flashlight to illuminate a dim place for the convenience of applying the lipstick.

DETAILED DESCRIPTION OF THE PREFERRED EMBODIMENT

Figure 1:
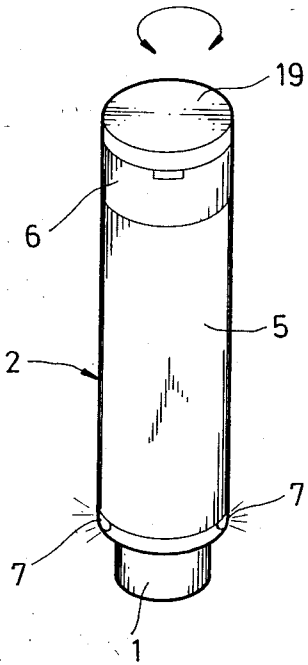
FIG. 1 shows the lipstick cap associated with one end of the lipstick seat to encase the lipstick and serve as a flashlight.

First referring to FIG. 1 the lipstick cap 2 of the present invention is associated with a lipstick seat 1 when not used. The lipstick cap 2 can be alternatively associated with the seat 1 in a reverse direction for normal use as shown in FIG. 2.

Figure 3:
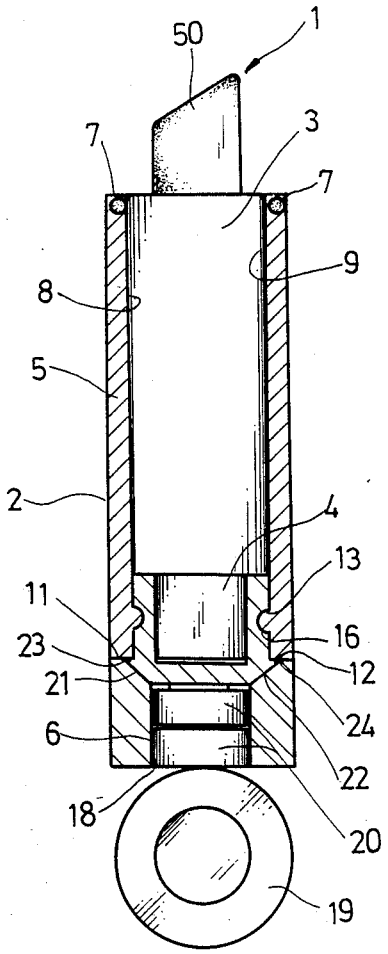
FIG. 3 is a longitudinally sectional view of the lipstick cap.
Figure 4:
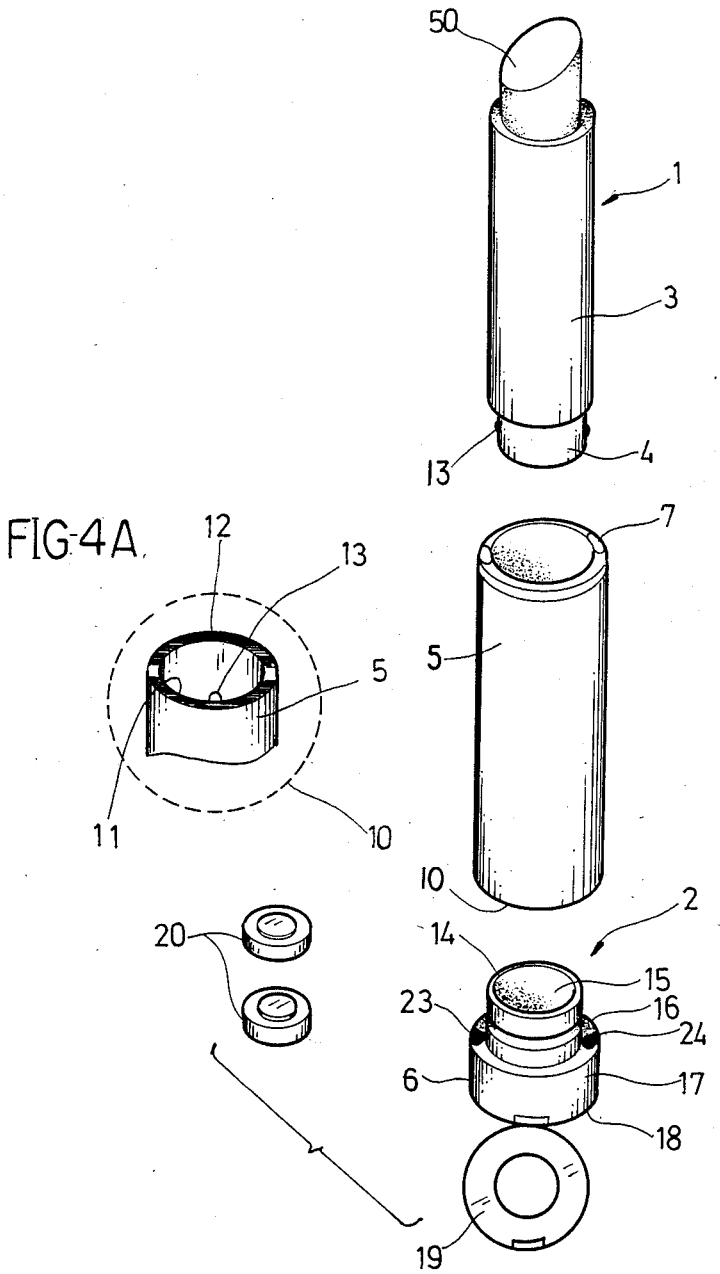
FIG. 4 is a perspective exploded view of the lipstick cap.

Now referring to FIG. 3 and FIG. 4, the lipstick cap 2 includes a cap sleeve 5 and a rotary switch 6 having an upper small diameter portion 14 and a lower large diameter portion 17, wherein the cap sleeve 5 is engaged with the upper portion 14 of the rotary switch 6. Several lamps 7 are disposed on the upper end of the cap sleeve 5 and two opposite conducting plates 8, 9 are disposed on the inner wall of the cap sleeve 5 to connect the lamps 7 in series. Two separate conducting semirings 11,12 are further disposed on the lower end surface of the cap sleeve 5 to respectively electrically connect with conducting plates 8,9. Two ball tenons 13 are provided on the inner wall adjacent to the lower end of the cap sleeve 5, and a annular groove mortise 16 are correspondingly located on the upper portion 14 of the rotary switch 6, permitting the rotary switch 6 to rotate in the cap sleeve 5 without axial movement. The rotary switch 6 has an upper opening 15 fit to receive the lower end of a lipstick seat, and a bottom battery container 18 covered by a cover plate 19 to contain batteries 20. The battery container 18 has an anode conducting plate 21 and a cathode conducting plate 22 obliquely going through the upper walls of the lower portion 17 of the rotary switch 6 to respectively connect the anode and cathode of the battery container 18 to a pair of joint points 23,24 disposed on the seep portion between the upper portion 14 and lower portion 17 of the rotary switch 6.

As shown in FIG. 3 and FIG. 4, batteries 20 are contained in the battery container 18 with the cover 19 mounted thereon. The upper portion 14 is fitted into the lower end of the cap sleeve 5 with the ball tenons 13 engaged with the annular groove mortise 16, permitting the rotary switch 6 to rotate about the cap sleeve 5 without axial movement. When turning the rotary switch 6, the joint points 23, 24 are alternatively electrically connected to the semirings 11, 12 and consequently connected to the lamps 7 through the conducting plates 8,9, light up the lamps 7.

Figure 2:
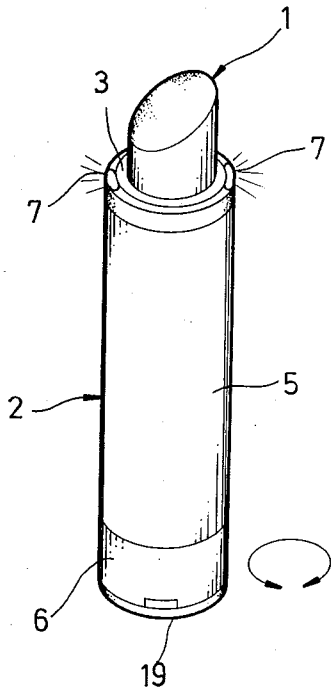
FIG. 2 shows the lipstick cap alternatively associated with the other end of the lipstick seat to facilitate the application of the lipstick.

When associated as shown in FIG. 1, the lipstick cap 2 is slipped on the lipstick seat 1, serving as a flashlight, while when associated as shown in FIG. 2 with the lower end 4 of the lipstick seat received in the upper portion 14, the lipstick lap 2 is suitable for rotating the lower end 4 to retractable extend the lipstick and lighting up the lamps 7 for the convenience of application of the lipstick in a dim condition.

The aforesaid separate conducting semirings 11, 12 are spaced from each other whereby the joint points 23, 24 can connect to or disconnect from the semirings 11, 12 by means of selectively turning the rotary switch 6, thus closing or opening the circuit to light up or shut off the lamps 7.

Many variations within the scope of the appended claims will be apparent to those skilled in the art once the principles described herein are understood.

What is claimed is:

1. A lipstick cap with lamp devices, comprising a cap sleeve used to receive common lipstick seat, having an upper end and a lower end, wherein said upper end is provided with several lamp devices, and said lower end is equipped with two separate conducting semirings, a pair of opposite conducting plates being mounted on said lipstick cap between said upper end and lower end to electrically connect said lamp devices to said semirings in series; and a rotary switch having an upper small diameter portion and a lower large diameter portion, forming a step portion there between, wherein said upper portion is rotarily received in said lower end of the cap sleeve, and said step portion has a pair of joint points capable of respectively selectively electrically connecting with said two semirings when turning said rotary switch, and said lower portion has a battery container covered by a cover, having an anode conducting plate and a cathode conducting plate penetrating through said battery container and respectively electrically connecting with said joint points whereby when batteries are mounted in said battery container, a circuit is formed and controlled by means of turning said rotary switch to connect said joint points to said semirings or disconnect the joint points from said semirings, and consequently, the lamps can be lighted up or shut off according to illuminating requirement.

2. A lipstick cap as claimed in claim 1, wherein several ball tensions are disposed inside said lower end of said cap sleeve, and an annular groove mortise is correspondingly located around said upper portion of said rotary switch whereby said cap sleeve can be rotarily associated with said rotary switch without axial movement via the engagement between said ball tenons and said annular groove mortise.

3. A lipstick cap as claimed in claim 1, wherein said upper portion of said rotary switch has a lipstick seat opening capable of fitly receiving the rotary switch can be turned to rotate said rotary lower end of a commer lipstick seat whereby the rotary switch can be turned to rotate said rotary lower end of the lipstick seat to retractably extend the lipstick as well as control said circuit to light up said lamp devices as necessary.

4. A lipstick cap as claimed in claim 1, wherein said cap sleeve can fitly receive the lipstick seat in two reverse directions, one of which allows the normal application of the lipstick with selective illuminating effect, and the other of which closes the lipstick seat, permitting the lipstick cap to cap to be used as a flashlight.

* * * * *